United States Patent [19]

Mostert et al.

[11] Patent Number: 4,946,515

[45] Date of Patent: Aug. 7, 1990

[54] HIGH STRENGTH HIGH TOUGHNESS STEEL AND METHOD OF MANUFACTURING THEREOF

[75] Inventors: Roelof J. Mostert, Verwoerdburg; Rudolf P. Badenhorst, Pretoria, both of South Africa

[73] Assignee: Iscor Limited, Pretoria, South Africa

[21] Appl. No.: 149,121

[22] Filed: Jan. 27, 1988

[30] Foreign Application Priority Data

Jan. 29, 1987 [ZA] South Africa ..... 87/0651

[51] Int. Cl.[5] ..... C21D 8/00; C22C 38/06

[52] U.S. Cl. ..... 148/12 F; 148/12 B; 148/333

[58] Field of Search ..... 148/12 F, 12 B, 12.3, 148/333

[56] References Cited

FOREIGN PATENT DOCUMENTS 56-33426 4/1981 Japan ..... 148/333

58-136715 8/1983 Japan ..... 148/333

*Primary Examiner*—Deborah Yee

*Attorney, Agent, or Firm*—Ladas & Parry

[57] ABSTRACT

A relatively low cost, high strength, high toughness bar and sheet steel, which is substantially non-susceptible to the formation of delayed surface cracks in the as-rolled condition and its method of preparation, are provided, the constitution of the steel on a percentage mass to mass basis being as follows:

C=0.21–0.28
Mn=0.80–1.80
Cr=1.60–2.10
Si=0.35 maximum
Al=0.02–0.05
P and S each=0.025 maximum
Fe=the balance;

the steel being characterized in that its composition is such that, upon air cooling following rolling, the transformation temperature of the steel during the cooling is at a sufficiently high level to ensure that there is sufficient thermal contraction possible after the transformation has been completed to accommodate at least the thermal expansion which had taken place during the transformation.

5 Claims, 3 Drawing Sheets

HIGH STRENGTH HIGH TOUGHNESS STEEL AND METHOD OF MANUFACTURING THEREOF

This invention relates to a high strength high toughness steel, and its method of preparation. Such steel, particularly in the form of round bars, can be utilised in the manufacturing of bolts, chains, agricultural implements such as spades, etc.

The steels which have thus/far been manufactured for the aforesaid purpose, suffer from the disadvantages that they either include a relatively high concentration of the relatively expensive alloying elements such as molydenum, nickel and chromium and/or that they require special heat treatments in their manufacture. Apart from the fact that such a high alloy content makes the steel expensive, it has also been found that such steels are more susceptible to the development of delayed surface cracks, especially in the case of round bars.

It is accordingly an object of this invention to provide a novel steel which can be used in the aforesaid applications, and a method for its manufacture, with which the aforesaid problems may be overcome or at least minimised.

According to the invention a relatively low-cost, high strength, high toughness bar and sheet steel which is substantially non-susceptible to the formation of delayed surface cracks in the as rolled condition is provided which has the following constitution on a percentage mass to mass basis:

C=0.21–0.28
Mn=0.80–1.80
Cr=1.60–2.10
Si=0.35 maximum
Al=0.02–0.05
P and S each=0.025 maximum
Fe=the balance;

the steel being characterised in that its composition is such that, upon air cooling following rolling, the transformation temperature of the steel during the cooling is at a sufficiently high level to ensure that there is sufficient thermal contraction possible after the transformation has been completed to accomodate at least the thermal expansion which had taken place during the transformation.

In this manner the development of residual stresses on the surface of the steel, which has been found to be the main cause of delayed suface cracking, are avoided, while the properties or hardness, toughness and tensile strength required for the aforesaid purpose, are retained.

It is believed that the resultant residual stress on the surface of a bar made of such steel is primarily dependent on the total volume change of the core subsequent to that instant when the surface of the bar has transformed to form a solid "cylinder" of martensite or bainite. Prior to that critical instant, high surface residual stresses cannot develop because the maximum value of residual stresses that can be accommodated in the surface structure (which is still austenite prior to that instant) is equal to the yield strength of the structure, and in the case of austenite, this value is rather low.

However, as soon as a solid "cylinder" of martensite/bainite has formed on the surface, much higher residual stresses can develop due to the high yield strength of these structures. If the total volume change of the core subsequent to that instant is positive, the expansion of the core will result in detrimental residual tensile surface stresses, Conversely, if the total subsequent volume change of the core is negative, the contraction of the core will result in compressive surface stresses, which are beneficial.

BRIEF DESCRIPTION OF THE DRAWINGS

The effect of residual stresses on the surfaces of both air cooled and water quenched steel bars in relation to the development of delayed surface cracks, is indicated in FIG. 1 of the enclosed drawings, which reflects experimental results obtained by the Applicant. As will be noted, there is a good correlation between high residual tensile stresses and crack occurence.

Applicant has found that the restriction of the chromium content of the steel to the stated range is critical in order to ensure both low residual stresses in the rolled condition and good toughness and strength after the final heat treatment of the product.

Figure 1:
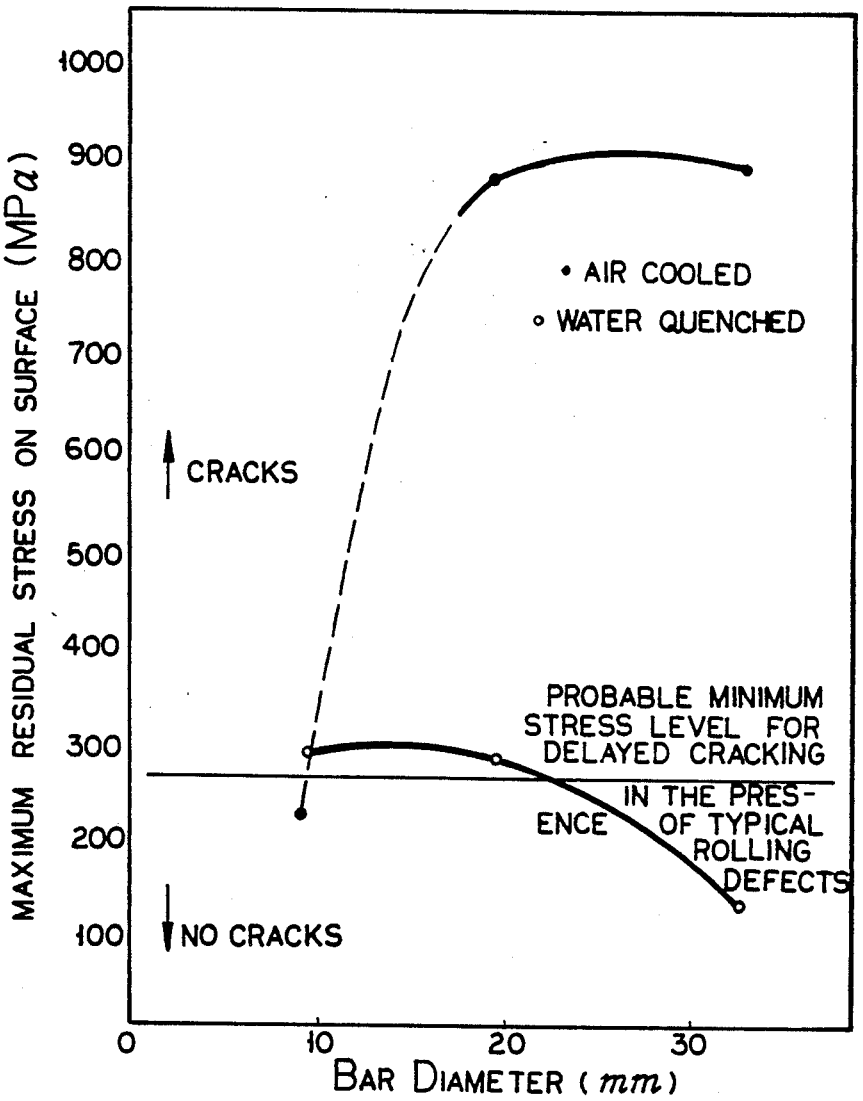
Figure 2:
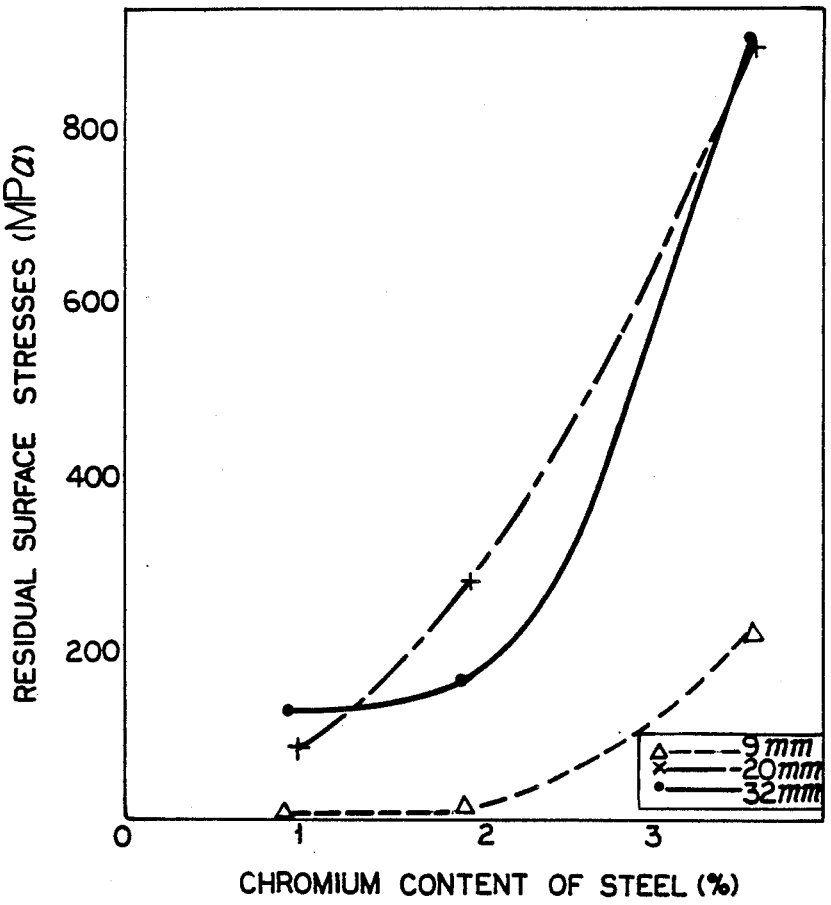

The interrelationship between residual surface stresses (and hence crack development) and chromiun content is shown in the enclosed FIG. 2 of the drawings which reflects the results obtained experimentally with three bars of different diameters made of steel according to the invention.

As will be noted from FIG. 2, the residual stress level on such a steel increases dramatically with increased chrominum content.

On other hand, as indicated in the following table, the Charpy-properties of the steel are fairly poor when the chromium content is below 2%.

Properties of the experimental steels D2 and D5 (32 mm rounds, water quenched and tempered at 200° C. for one hour) compared with an existing steel QT4.

| Steel | Hardness (HV30 kgf) | Chirpy properites at −10° C. | Chirpy properites at 20° C. | Tensile properties Rp (0,2%) MPa | Rm (MPa) | % Red of area | % el |
|---|---|---|---|---|---|---|---|
| D2 | 473 | 26 | 35–48 | 1218 | 1501 | 30,5 | 11,6 |
| D5 | 502 | 42 | 47 | 1356 | 1643 | 55,4 | 12,7 |
| QT4 | 508 | 35 | 41 | 1279 | 1578 | | 12,6 |

Chemical compositions of existing and experimental steel types.

| Steel | C % | Mn % | P % | S % | Si % | Cu % | Cr % | Al % |
|---|---|---|---|---|---|---|---|---|
| QT4 | 0,24 | 1,55 | 0,014 | 0,001 | 0,18 | — | 3,58 | 0,013 |
| D2 | 0,25 | 1,26 | 0,009 | 0,007 | 0,31 | 0,03 | 0,95 | 0,012 |
| D5 | 0,27 | 1,13 | 0,010 | 0,005 | 0,28 | 0,05 | 1,93 | 0,057 |

It has accordingly been found that at higher chrominum levels than that of the stated range, delayed surface cracking occurred in the as rolled condition, while at lower chromium levels than that of the stated range, adequate tensile and impact strength levels for the stated purpose could not be realised after heat treatment of the final product.

It will be appreciated that the chromium level of a steel according to the invention is much lower than that of existing steels utilised for the same purpose. Applicant has however found that the achievement of the required properties can be enhanced through an appropriate selection of the concentration of the other elements, particularly the manganese, within the aforesaid range.

Furthermore, apart from a cost advantage, another advantage of such low chromium content is that the steel of the invention need not be heated to the same relatively high temperatures usually required for similar steels during their heat treatment.

Figure 3:
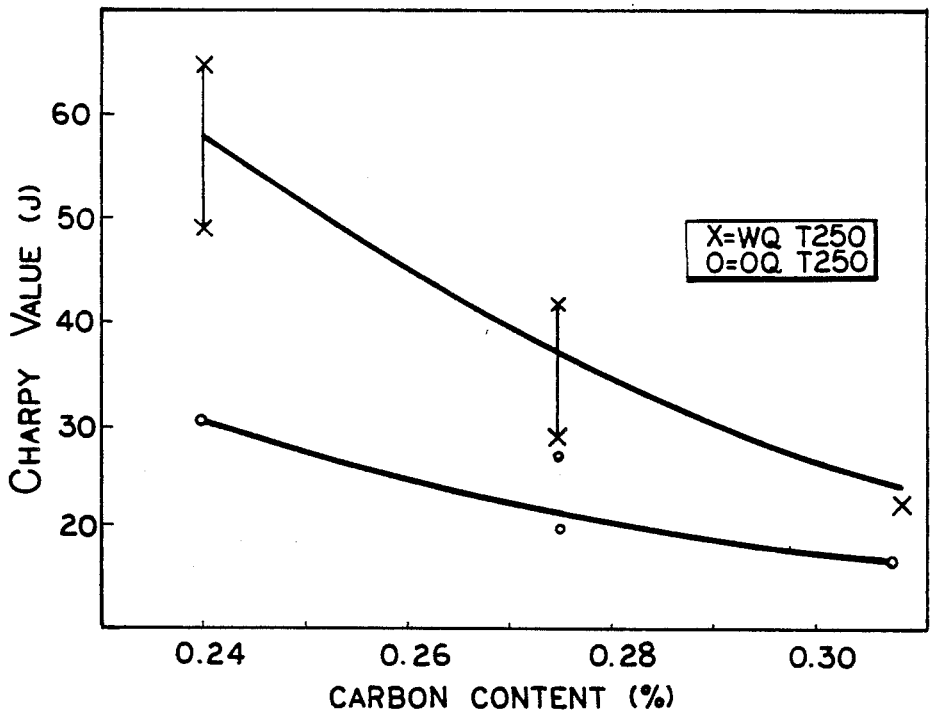

The effect of changes in the carbon content of the steel on impact energy levels is shown in the enclosed FIG. 3, which reflects results obtained experimentally. From this it will be noted that an increase of carbon content of a 20 mm bar from 0,24 to 0,31%, gives a decrease in Charpy values at 20° C. from 60 to 20 Joule.

Further according to the invention the concentration of the aforesaid constituents of the steel are so chosen that the physical properties of the steel are within the following range:

| | |
|---|---|
| Hardness = | 470–520 Vickers; |
| Yield limit = | 1250–1350 MPa |
| Tensile strength = | 1500–1650 MPa |
| Charpy toughness = | 30–60 joule at 20° C. |

Still further according to the invention a method of manufacturing a relatively low cost, high strength, high toughness bar and sheet steel, which is substantially non-susceptible to the formation of delayed surface cracks in the as rolled condition, and of which the constitution on a percentage mass to mass basis is within the following range:

C=0.21–0.28
Mn=0.80–1.80
Cr=1.60–2.10
Si=0.35 maximum
Al=0.02–0.05
P and S each=0,025 maximum
Fe=the balance; is provided, the method being characterised in that the chosen constitution of the steel is such that, upon air cooling following rolling, the transformation temperature of the steel during cooling is at a sufficiently high level to ensure that there is sufficient thermal contraction possible after the transformation has been completed to accomodate at least the thermal expansion which had taken place during the transformation.

Further according to the invention the method includes the step of subjecting the air cooled rolled product to a subsequent heat treatment which entails heating it to an austenitizing temperature in the order of 900° C. and quenching it with water or oil or, where the product is relatively thin, allowing it to air cool.

Preferably, also, the method includes the step of tempering the heat treatment product at a temperature in the order of 225° C. for one hour per 25 mm thickness.

Applicant has found that the best Charpy properties were obtained with water quenched and tempered (250° C., one hour) 20 mm bars, in which case a 20° C. Charpy value of 49–64 Joule was obtained. Even at fairly low Charpy test temperatures, very good Joule values (25–50 J at −10° C.) were still obtained.

Applicant has found that the Charpy properties of the oil quenched samples were poor, which could possibly be attributed to bainite formation during the typical slow cooling in the $M_s$-temperature region.

In one method for the preparation of a steel according to the invention, which will now be described by way of example, a steel melt of a constitution chosen within the aforesaid range was prepared and allowed to solidify. It was then reheated to approximately 1250° C., rolled into the required shape, and allowed to cool. The solidified steel product was reheated to ±900° C. for one hour per 25 mm thickness, whereafter it was quenched with water or oil, but preferably water, or, where the material was very thin, merely by air cooling. For optimum toughness the steel was then tempered at a temperature in the order of ±250° C. for one hour per 25 mm thickness in order to obtain a product with the optimum properties within the aforesaid stated range. This is, however, an optional step and applicant has found that without it an acceptable product was still possible although its toughness value was slightly lower than that given above.

In a further experiment involving a full production melt, round bars of 9, 16, 20 and 32 mm diameter were rolled from steel according to the invention. Some of the properties of this steel are reflected in the following table:

| | C % | Mn % | P % | S % | Si % | Cr % | Al % | H |
|---|---|---|---|---|---|---|---|---|
| Specification | 0.21/ 0.26 | 0.90/ 1.25 | 0.025 max | 0.025 max | 0.10/ 0.35 | 1.60/ 2.0 | 0.02/ 0.05 | |
| Pit analysis | 0.24 | 1.18 | 0.013 | 0.010 | 0.16 | 1.87 | 0.018 | 1.5 ppm |
| Leco product analysis | 0.24/ 0.31 | 1.05/ 1.20 | 0.013/ 0.015 | 0.007 0.010 | 0.16/ 0.17 | 1.76/ 1.86 | 0.013 0.014 | |

The principal residual surface stresses of these bars in various heat treatment conditions were determined, and are compared in the following table to that of production bars of conventional ones having a higher Cr analysis of 4%.

Maximum surface residual stresses on production bars

| Sample | Maximum residual stress on surface, MPa (-compressive) |
|---|---|
| Product of the invention | |
| 9 mm As rolled | 175 |
| 16,5 mm As rolled | 95 |
| 20 mm As rolled | 184 |
| 32 mm As rolled | 151 |
| 9 mm WQT250 | 118 |
| 20 mm WQT250 | −126 |
| 20 mm OQT250 | −377 |
| 32 mm WQT250 | −466 |
| 32 mm OQT250 | 144 |

-continued

| Maximum surface residual stresses on production bars | |
|---|---|
| Sample | Maximum residual stress on surface, MPa (-compressive) |
| Conventional product (4% Cr) | |
| 9 mm As rolled | 295 |
| 19 mm As rolled | 881 |
| 32 mm As rolled | 893 |

*Legend:
WQ = water quenched
T250 = 250° C.
OQ = oil quenched

The low residual stresses of the steel according to the invention bars in the air-cooled condition resulted in the bars not developing cracks in either the as-rolled, oil quenched or water quenched condition. Extensive optical, dye penetrant, magnetic fluorescent particle and metallographical examinations were done on a number of such bars and, except for cracks associated with rolling defects in the front ends of the bars, the bars were free of defects. Some in-line quenched 20 mm bars, however, developed cracks.

Tensile properties in various heat treatment conditions were determined according to ASTM and are given in the following table. The good combinations of strength and ductility in the samples tempered at 200°-250° C. should noted.

| Section size and heat treatment | Tensile properties in various heat treatment conditions: Yield stress Rp 0,21 (MPa) | Ultimate tensile stress (MPa) | % Elongation | % Reduction in area |
|---|---|---|---|---|
| 20 mm water quenched (WQ), tempered (T) at 200° C. | 1257 | 1583 | 14,3 | 56 |
| 20 mm oil quenched (OQ), T 200° C.* | 1253 | 1633 | 13,3 | 53 |
| 20 mm WQT250* | 1194 | 1470 | 12,1 | 66 |
| 32 mm WQT200* | 1356 | 1701 | 12,1 | 56 |
| 32 mm OQT200 | 1180 | 1502 | 14,4 | 56 |
| 20 mm WQT675 | 727 | 823 | 19,7 | 72 |
| 32 mm WQT675 | 747 | 851 | 19,8 | 72 |

*Non-standard tensile tests

Other properties which were determined are given in the following table.

| Heat treatment condition and section size | Charpy properties: Test temperature (°C.) | Joule value | Vickers hardness (30 kgf) |
|---|---|---|---|
| 20 mm OQT250 | −10 | 20.30 | 480 |
| | 20 | 30.30 | |
| 32 mm OQT250 | −20 | 16.20 | 490 |
| | 20 | 29.35 | |
| 20 mm OQT400 | 20 | 21.21 | |
| 32 mm WQT250 | | | 501 |
| 32 mm WQT200 | | | 546 |
| 32 mm OQT200 | | | 475 |
| 20 mm OQT350 | 20 | 9 | |

It will be appreciated that the invention provides a steel and a method for its preparation, of relatively low cost, but with a sufficiently high strength and toughness to make it suited for the aforesaid stated purpose and with which the problems stated in the preamble of this specification encountered with existing steels intended for the same purpose are overcome or at least minimised.

It will be appreciated further that there are no doubt many variations in detail possible with a steel according to the invention, and its method of preparation, without departing from the spirit and/or scope of the appended claims.

We claim:

1. A, high strength, high toughness bar and sheet steel which is substantially non-susceptible to the formation of delayed surface cracks in the as rolled condition, and which has the following constitution on a percentage mass to mass basis:

C=0.21-0.28
Mn=0.80-1.80
Cr=1.60-2.10
Si=0.35 maximum
Al=0.02-0.05
P and S each=0.025 maximum
Fe=the balance;

wherein the concentration of the constituents of the steel are chosen so that the physical properties of the steel are within the following range:

| | | |
|---|---|---|
| Hardness = | 470-520 | Vickers |
| Yield limit = | 1250-1350 | MPa |
| Tensile strength = | 1500-1650 | MPa |
| Charpy toughness = | 30-60 | joule at 20° C. |

the steel having been subjected to air cooling following hot rolling, with the transformation temperature of the steel during the cooling being at a sufficiently high level to ensure that there is sufficient thermal contraction possible after the phase transformation has been completed to accommodate at least the thermal expansion which had taken place during the transformation.

2. A method of manufacturing a high strength, high toughness bar and sheet steel, which is substantially non-susceptible to the formation of delayed surface cracks in the as rolled condition, and of which the constitution on a percentage mass to mass basis is within the following range:

C=0.21-0.28
Mn=0.80-1.80
Cr=1.60-2.10
Si=0.35 maximum
Al=0.02-0.05
P and S each=0.025 maximum
Fe=the balance;

wherein the concentration of the constituents of the steel are chosen so that the physical properties of the steel are within the following range:

| | | |
|---|---|---|
| Hardness = | 470–520 | Vickers |
| Yield limit = | 1250–1350 | MPa |
| Tensile strength = | 1500–1650 | MPa |
| Charpy toughness = | 30–60 | joule at 20° C. |

the method comprising the step of air cooling the steel following hot rolling, with the transformation temperature of the steel during cooling being at a sufficiently high level to ensure that there is sufficient thermal contraction possible after the phase transformation has been completed to accomodate at least the thermal expansion which had taken place during the transformation.

3. The method of claim 2 including the step of subjecting the air cooled as-rolled product to a subsequent heat treatment which entails heating it to an austenitizing temperature in the order of 900° C. and quenching it with water or oil.

4. The method of claim 2 including the step of subjecting the air cooled as-rolled product to a subsequent heat treatment which entails heating it to an austenizing temperature in the order of 900° C. and, where the product is relatively thin, allowing it to air cool.

5. The method of claim 3 including the step of tempering the heat treated product at a temperature in the order of 225° C. for one hour per 255 m thickness.

* * * * *